United States Patent [19]

Rudy

[11] Patent Number: 4,506,460

[45] Date of Patent: Mar. 26, 1985

[54] SPRING MODERATOR FOR ARTICLES OF FOOTWEAR

[76] Inventor: Marion F. Rudy, 19001 Vintage St., Northridge, Calif. 91324

[21] Appl. No.: 496,411

[22] Filed: May 25, 1983

Related U.S. Application Data

[63] Continuation-in-part of Ser. No. 389,866, Jun. 18, 1982.

[51] Int. Cl.[3] ..... A43B 13/18

[52] U.S. Cl. ..... 36/28; 36/38; 36/44; 36/69

[58] Field of Search ..... 36/76 C, 88, 114, 129, 36/43, 44, 69

[56] References Cited

U.S. PATENT DOCUMENTS

| | | | |
|---|---|---|---|
| 371,657 | 10/1887 | Adams et al. | 36/43 |
| 1,013,727 | 1/1912 | Baumann | 36/43 |
| 1,090,106 | 3/1914 | Montine | 36/69 |
| 2,123,567 | 7/1938 | Gilbert | 36/43 X |
| 2,185,995 | 1/1940 | Haskell | 36/43 X |
| 2,211,057 | 8/1940 | Duckoff | 36/43 X |
| 2,255,100 | 9/1941 | Brady | 36/37 X |
| 2,348,300 | 5/1944 | Klaus | 36/43 X |
| 2,660,814 | 12/1953 | Ritchey | 36/37 X |
| 2,808,664 | 10/1957 | Frieder et al. | 36/44 X |
| 3,120,712 | 2/1964 | Menken | 36/29 |
| 3,253,355 | 5/1966 | Menken | 36/29 |
| 4,183,156 | 1/1980 | Rudy | 36/29 X |
| 4,219,945 | 9/1980 | Rudy | 36/29 |

FOREIGN PATENT DOCUMENTS

| | | | |
|---|---|---|---|
| 458300 | 4/1928 | Fed. Rep. of Germany | 36/43 |
| 540521 | 1/1932 | Fed. Rep. of Germany | 36/44 |
| 673150 | 3/1939 | Fed. Rep. of Germany | 36/44 |
| 759432 | 11/1933 | France | 36/43 |
| 1208120 | 9/1959 | France | 36/129 |
| 7906118 | 2/1981 | Netherlands | 36/69 |
| 223524 | 10/1924 | United Kingdom | 36/44 |

*Primary Examiner*—Werner H. Schroeder
*Assistant Examiner*—Tracy Graveline
*Attorney, Agent, or Firm*—Beehler, Pavitt, Siegemund, Jagger & Martella

[57] ABSTRACT

Footwear includes a high modulus moderator located between the wearer's foot and cushioning material above the foot in which the moderator is a relatively thin, lightweight material having a modulus of elasticity of at least about 250,000 psi. The heel moderator includes medial and lateral legs positioned to be located under the calcaneus of the foot with the cushioning located beneath the moderator such that a cushioning medium is located below the calcaneus. The moderator, which deflects without permanent deformation and includes portions extending upwardly, operates to absorb, redistribute and sore the energy of localized loads. A moderator may also be located under the forefoot, as described.

21 Claims, 13 Drawing Figures

Fig. 7.a
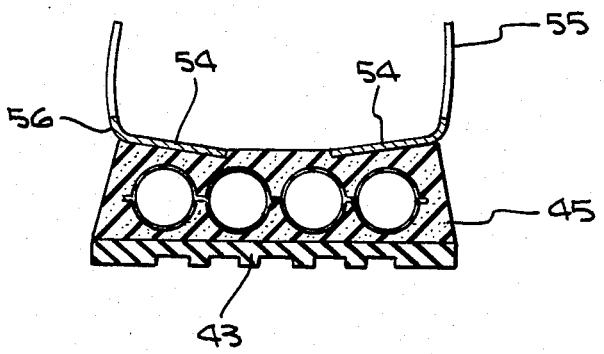
Fig. 8.
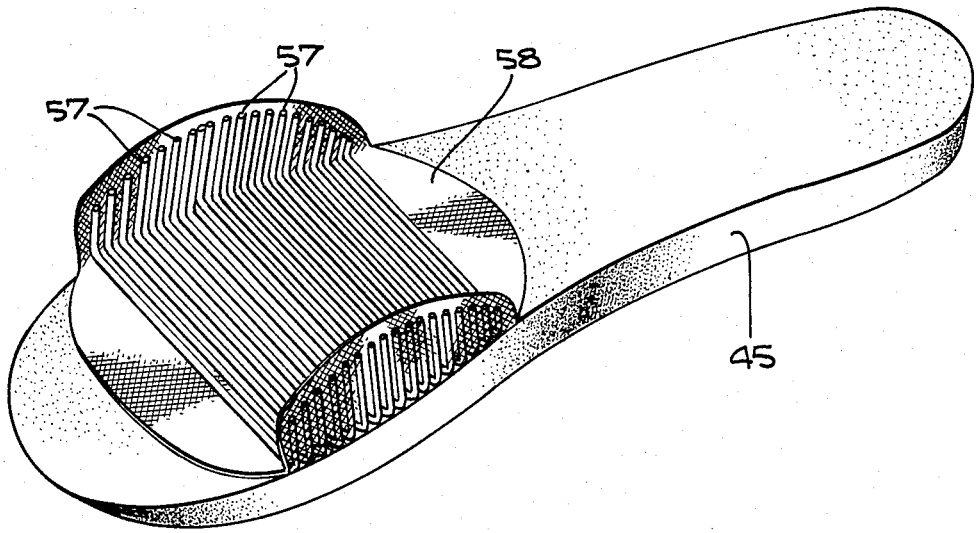

SPRING MODERATOR FOR ARTICLES OF FOOTWEAR

RELATED APPLICATIONS

This application is a continuation-in-part of application Ser. No. 389,866, filed June 18, 1982.

BACKGROUND OF THE INVENTION

1. Field of the Invention

This invention relates to moderators and stabilizers of footwear, and more particularly to an improved spring moderator and stabilizer which absorbs, redistributes, and stores energy of localized loads and forces, through elastic deformation, and then returns the energy to the user in useful form as the load is removed. Improved comfort, support, and stability for the foot and lower leg are also provided.

2. Description of the Prior Art

There are numerous articles of footwear in the prior art in which inserts and supporting members are present, principally for the purpose of providing comfortable support to the human foot. For example, U.S. Pat. No. 3,120,712 of 1964 issued to Menken describes a shoe construction which includes a bladder filled to a pressure of about 30 psi. A steel plate overlies the bladder to confine it, and, at a pressure of 30 psi, the plate must support and control a force of 600 pounds and must, accordingly, be extremely rigid and inflexible.

U.S. Pat. No. 2,237,190 of 1941 issued to McLeod describes a shoe incorporating supporting members of springy material which supporting members are corrugated transversely and are thus rigid in a transverse orientation.

U.S. Pat. No. 3,253,355 of 1966 also issued to Menken also describes the use of a stiff plate over an inflatable bladder. The primary purpose of these plates is to contain the fluid pressure within the bladder to provide a flat surface under the foot.

Other patents exist which describe a stiffening or reinforcing plate in the shoe structure, such as arch support devices and the like.

U.S. Pat. No. 4,183,156 discloses a "moderator" described as uniformly distributing relatively high loads associated with fluid-containing chambers in the shoe structure. The moderator is described as being relatively thin, 0.005 to 0.080 of an inch, and is described as being "semi-flexible" to conform to the dynamic contours of the planar surface of the foot. This prior moderator, however, does not perform the function of an energy absorbtion transfer storage and recovery mechanism, but is used solely for foot comfort.

While the above described inserts and supporting members and moderators, as well as others described in the prior art, are said to perform in a manner satisfactory for the purposes therein disclosed, none of the prior art anticipates the basic concepts of this invention: i.e., (a) The use of thin high modulas of elasticity, flat or shaped flexural spring elements(s) to absorb otherwise wasted energy from the foot at footstrike, and;

(b) Re-distribute this energy in a time phased relation to the movements of the foot so as to use this otherwise wasted energy to perform other useful functions in the article of footwear, such as:

(1) to cushion and greatly reduce damaging and injury causing shock forces to the foot, leg and body, when walking, running or jumping.

(2) to provide automatic, dynamic improved rear foot and heel support, stability and motion control directly proportioned to the need of the athlete, and/or, (3) to provide automatic, dynamic improved forefoot control and stability particularly for blocking and stopping movements.

(c) To store this energy in a relatively efficient manner within the spring system.

(d) To return this energy to the wearer of the footwear in a time phased, dynamic, and useful manner to:

(1) improve overall efficienty, (2) reduce fatigue, (3) extend the "float time" for the runner, (4) to increase the jump height for the basketball player.

The subject invention is tailored to work with either, or a combination of fluid/pneumatic and or elastomeric foam support systems.

More specifically, the moderator of this invention provides a variety of unique qualities and functions in combination with elastomeric and/or inflatable elements not heretofore achieved. It is known in the prior art to use foamed inserts or inflatable inserts, normally used as in-soles in foorwear. U.S. Pat. Nos. 4,183,156 and 4,219,945 describe inflatable inserts and combinations thereof with elastomeric materials. These latter patents represent an improvement over the prior art in that the described in-soles absorb localized forces and re-distribute these forces from the localized area, the absorption of forces operating throughout the fluid system of the in-sole. In effect, the fluid system acts as a pneumatic spring. However, they do not combine the elastomeric or inflated elements with a spring-type moderator/stabilizer as in this invention. The moderator of this invention, which is in the nature of a mechanical spring, enhances and improves the energy absorption, redistribution, storage and energy return of the above types of in-soles. Where the in-sole is an all-foam, non-inflatable type of insert, the moderator of the present invention provides similar improved benefits to those of the pressured pneumatic systems.

In general, the moderators of the prior art are either rigid and inflexible and do not conform to the wearer's foot or they are rigid and inflexible and designed to support the foot in a predetermined manner. Alternatively, some are moldably flexible to conform to a desired contour of the foot. In some of the prior art structures the energy of the applied localized load is merely absorbed, and wastefully dissipated, and little, if any, of the absorbed energy is returned in a useful form. Where the energy is merely absorbed, it is usually dissipated in the form of heat, which builds up over a period of time, thereby generating a rise in temperature that may adversely affect the comfort and durability of the footwear.

With footwear to be used in sports related activities, or in severe types of physical activities, the interaction between the foot, footwear and the surface may vary widely, depending upon the nature of the particular activity, the footwear, and the surface. For example, in long distance running, the sequence generally involves heel strike, pronation, and a toe-off "propulsion phase" which is followed by a "float phase." The foot is actually on the ground for only a relatively short period of time. For example, less than 0.30 of a second, and the force loading on the foot may be quite high. In the heel-strike phase, from two to eight times the body weight comes down on the heel in a comparatively short period, and the localized loads may range from about 400 to 1,800 pounds. Where the surface is hard, for example concrete or hardtop, and the footwear is non-compressible, the high loads are absorbed by the heel and transmitted through the related bone structure to the remainder of the body. Thus, from the standpoint of comfort and protection from injury, either a soft running surface or a soft cushioned shoe structure, or a combination thereof is desirable.

However, the toe-off propulsion phase tends to require firmness because of the propulsion mechanism. Here, more firm surface and a less cushioned shoe structure, or a combination thereof, is desirable. For footwear of a given type, the effect may be different for different types of surfaces, e.g., turf, concrete, or hardwood surfaces. Turf is yielding and while it cushions heel strike better than does concrete or hardwood, the yielding nature makes toe-off propulsion more strenuous. Concrete and hardwood favor the dynamics of toe-off propulsion, and hardwood is preferable over concrete because hardwood is somewhat resilient and tends to cushion heel strike. While the almost imperceptable resiliency of hardwood compared to concrete might not seem significant, it is very significant from the standpoint of foot comfort and protection from injury for the athlete. It is primarily for this reason that hardwood rather than much less costly concrete floors are used in most gymnasiums.

From the nature of distance running, it is important that the footwear used be designed to not only give the proper amount and degree of cushioning protection at heel strike, the footwear should also be capable of (a) redistributing and efficiently storing the energy at heel strike (which is composed of both a negative downward and reward force vector) and (b) returning that stored energy to the athlete as a positive propulsive force having both upward and forward vectors. This energy must also be returned to the athlete in a properly time-phased relation to the rhythm of his gait, (i.e., that is in resonance with the articulated pendulum movement of his legs and feet—and the up and down 'bouncing ball' movement of his head and torso) so as to enhance and not retard the activity. It should be noted here the importance of proper timing in the return of the stored energy. If the energy returns too rapidly, it could actually detract from the overall efficiency and could cause a runner to run more slowly and with less efficiency. If the energy is returned too slowly, there would be little or no efficiency improvement and the energy would simply be thrown away.

It may appear difficult or impossible to store enough energy within the thin sole of a shoe to significantly improve the efficiency and performance of an athlete, such as a distance runner. However, a recent technological advancement has been made in athletic footwear that has achieved the above goals. It is the Air-Sole® described in my earlier U.S. Pat. No. 4,183,156. Extensive testing by hundreds of professional athletes reveal efficiency gains when using Air-Sole® shoes, in the range of ½% to as high as 3½%. Even gains as small as ½%, as measured in treadmill/oxygen uptake tests, are physiologically significant and translate into both increased speed and endurance for the athlete. For example, an energy savings of 0.8% is equivalent to roughly one minute and 25 seconds at a three hour marathon race and about one minute at a two-hour and ten minute marathon race. Thus a relatively lightweight, comfortable shoe, which increases efficiency by only a fraction of one percent, represents a significant and beneficial advance in the art.

The nature of the physical activity is an important factor in footwear design and engineering. Long-distance running involves repeating cycles (heel strike, pronation, toe-off propulsion followed by a float phase) with reasonably identical loading patterns. In basketball, for example, the situation is quite different, because the cycle is not repeatable because of the variety of movements in the sport. Also, some of these movements are of such a nature that when the foot or some portion thereof comes into contact with the floor, the loads may be significantly higher and in different directions than those involved in running. For example, a basketball player may come down on the ball or heel of one foot after a high jump thereby causing the localized loads to be significantly in excess of those normally encountered in the heel strike phase of long-distance running. Further, the nature of the sport is such that quick starts, stops and changes of direction take place in a random, non-cyclicle manner. To some extent, the same is true in sports such as soccer or football played on artificial turf or grass, but the surface tends to be more resilient than the hardwood surface. Also, tennis presents the same variety of foot motion, although high jumps are not as frequent. However, the surface is usually very hard.

It is known from U.S. Pat. No. 4,183,156 that particular types of inflatable in-sole structures there described are capable of absorbing localized forces and storing and returning mechanical energy to the foot and leg so as to reduce the "energy of locomotion" required in running, walking and jumping. As described in the above-identified patent, displacement energy is absorbed from the foot by the inflated in-sole as the foot makes contact with the ground, the energy being converted to fluid pressure energy and stored within the inflated in-sole and then is converted back to energy of motion at the end of the stride as the foot leaves the ground. The described in-soles are initially filled with one, or a combination of special, inert, man-made, high molecular weight gases so as to achieve essentially permanent inflation coupled with the unique abilities to automatically compensate (over a period of time) for ambient changes in pressure such that the differential pressure (i.e., the pressure inside the device vs. the ambient pressure outside the device) remains essentially constant for the life of the product. Thus the product could be manufactured at sea level and used in high mountain areas and have the same "feel" and level of support. The reverse would also be true (i.e., manufacture the device at high elevation and then use it at sea level.

While the above-described in-soles have many new, novel and useful features, operate satisfactorily, and include moderators to provide comfort, in some applications it has been necessary to use relatively high inflation pressures and/or relatively high density, heavy weight foams to withstand the relatively large localized loads produced in certain types of activities such as jumping. Further, while those in-soles were effective in absorbing and converting the energy ultimately into energy of locomotion, the maximum use of the available energy was not achieved. More specifically, the redistribution of energy was related to the communicating fluid passages for the air-gas mixture, thus requiring in-sole geometries which tended to be difficult as a practical matter.

One of the advantages of the inflatable in-sole structures was the adiabatic compression of the gas in response to applied loads and the transfer of energy at a relatively high rate approximating the speed of sound, i.e., 1088 feet/second. Energy was also transferred stored throughout the elastomeric or plastic material which formed the fluid containing envelope, but the rate of energy transfer was significantly slower than that through the air-gas mixture. In the case of foam materials, the rate of energy transfer is relatively slow, e.g., about one foot per second or less. The result was that in some instances the dynamics of energy absorption, distribution and return was not properly "tuned" to the wearer's activity. The result was that the available energy was not as optimally utilized as it could have been.

Comfort and shock absorption are important factors by themselves that can increase efficiency and performance of the athlete. It has been shown that the body expends energy simply in absorbing and attenuating the impact and shock loads experienced in running. Further, sore, or even temporarily damaged muscles, ligaments, nerves, etc., do not function as efficiently as normal body elements. Hence the best possible shoe design will optimize the factors of (a) comfort and shock absorption, (b) lightness of weight, (c) efficient energy absorption, redistribution, storage and return, (d) rear foot, arch, and forefoot support and motion control. The Air-Sole® and variations thereof has achieved a significant degree of optimization of these factors not previously possible in any other footwear. However, there are certain requirements in footwear design where the present embodiment of the Air-Sole®, by itself, is not the best design. Furthermore, the subject of this invention is able to achieve many of the desirable energy absorption, redistribution, storage and return features of the Air-Sole®, without the use of the Air-Sole®, or, it can also be used to enhance the overall performance characteristics of shoes using the Air-Sole®. The subject invention is particularly valuable (in comparison with the Air-Sole® by itself) in achieving a unique and highly beneficial degree of dynamic rearfoot, arch and forefoot motion control and support, not presently possible with the Air-Sole® or any other footwear design. As will be seen in the following discussion, the special geometry and design of the spring moderator absorbs, redistributes, stores and returns energy to the athlete in a manner beneficially different from the Air-Sole® or any other prior art device.

In view of the foregoing, one of the objects of this invention is to provide an improved moderator which cooperates with the other components of the article of footwear to absorb, redistribute, store and return energy to the user in a far better fashion than can be achieved by the same structure without the moderator of this invention.

Additional specific objects of this invention include:

(a) Achievement of a "banked track" effect between the foot and the running surface proportional to the applied vector forces;

(b) Achievement of improved running efficiency when properly combined with either all foam and/or an air-gas in-sole system;

(c) Improvement of stability at heel strike and toe-off phases of footwear function regardless of whether an air-gas in-sole system is used;

(d) Providing improved and increased support for individuals defined as "pronators";

(e) Cooperating with the heel counter of the footwear to create a dynamic cupping action working in combination with the heel counter to snug the heel counter more firmly around the heel of the foot at moments of severe downward (or combined lateral and downward) impact between the foot and the ground;

(f) Permitting the use of softer foam and/or lower pressure air-gas in-soles to achieve higher levels of comfort and impact/shock absorption and at the same time to tune more precisely the dynamics of the shoe to the athlete and to the activity, for example, running, tennis, basketball, track, soccer, football, etc.;

(g) Absorbing, redistributing and storing the energy of localized loads and forces through elastic deformation of the spring moderator element and then returning the energy to the athlete as the load is removed;

(h) When used with footwear or in-sole constructions of the type described in U.S. Pat. Nos. 4,183,156; 4,219,156; 4,219,945 and 4,271,606 the moderator structure of the present construction (i) increases the energy absorption capability of the entire structure;

(ii) Achieves a better balance between comfort and firmness in the shoe structure;

(iii) improves the "jump height" blocking and stopping characteristics of basketball, tennis and other court shoes; and (iv) enhances and improves the energy absorption, redistribution, storage and energy return characteristics of those shoes and in-sole structures;

(i) Offers the advantage of use of foam in-sole components which are softer, less dense, and thus of lighter weight, thus retaining softness in the shoe, while providing firmness, as well as the energy return characteristics previously described;

(j) Permits the use of low-pressure inflatable inserts and lower density foams, without experiencing their undesirable "bottoming-out" characteristics, while still retaining the soft cushion feel, but with firmness of support;

(k) Enhances and improves the energy absorption, redistribution, storage and energy return characteristics of the foam or air-gas filled in-sole; and, (l) Provides a high level of lateral support to the foot, thus either eliminating or supplementing the need for foxing in court shoes and thereby both reducing the weight of the court or all purpose athletic shoe and increasing the level of support and motion control for the entire foot.

BRIEF DESCRIPTION OF THE INVENTION

By the present invention, the energy expenditure of the athlete is reduced significantly in performing the same level of work effort when the footwear includes a moderator of the present invention as compared to the same shoe without such a moderator.

The foregoing objects and advantages are achieved by an improved spring moderator made of a high modulus of elacticity material which is lightweight and cooperates with other components of the in-sole, insert or shoe structure to absorb, redistribute, store and return to the athlete in a useful form, through elastic deformation, the energy of localized loads, at the time the localized loads are removed. In effect, the present invention provides firmness and support and stability, while providing softness and cushioning, while returning absorbed energy in a useful form.

The moderator is comprised of a very thin spring-type material so located in the shoe structure as to elastically deform and absorb the high unit loads and which simultaneously functions to redistribute the loads radially outward over the surface of the moderator element and onto the elastically deformable material beneath or adjacent to the moderator. This energy absorption, transfer of storage function occurs almost instantaneously and in proportion to the force of the applied load. In thus spreading out and redistributing the applied loads, the unit loads (lbs/in.) transmitted to other elements of the shoe are reduced, thus permitting the use of new, different and lighter weight materials.

By way of comparison, pressurized fluid systems such as the Air-Sole® absorb localized loads and redistribute and store this energy throughout the inflated structure in a manner dependant upon the geometry of the pressurized compartments comprising the device. Foam systems are inherently not capable of redistributing the force or energy of an applied load away from the point or area of the load application.

When the spring moderator of the present invention is combined with the Air-Sole®, new, novel and very beneficial results are achieved. Synergism occurs wherein the resulting product has features not achievable by the use of either of the two systems independently. The performance and load-supporting characteristics of pressurized fluid systems is greatly improved by use of the present invention. Localized heavy loads that would normally bottom-out the Air-Sole®, are instantaneously spread out (moderated) over the air-chambers so as to achieve load support characteristics of the resulting system several times greater than without the spring moderation and permitting the use of more optimal lower "air" pressures capable of achieving higher levels of comfort under normal use conditions.

Thus, for example, the high-modulus of elasticity moderator comfortably and efficiently absorbs high shock forces at heel strike. The high localized forces at heel strike are cushioned and redistributed at the distal end of the calcaneus, both downwardly and laterally. This redistribution characteristic can be controlled by variations in the thickness, the modulus, and geometry of the moderator or moderator elements.

At the first instant of heel strike, the applied force is relatively light and there is a small degree of load redistribution. As the heel strike phase continues and the forces build, continued downward movement of the calcaneus produces (a) significant elastic deformation of the central heel portion of the moderator, and (b) redistribution of the localized load of the calcaneus outwardly over the softer supportive foam- or fluid-filled material. The result is a comparatively soft and comfortable support under low to moderate load and force conditions. As the load increases, however, the moderator structure continues to deflect and spread the load over a much greater area. Therefore the system becomes increasingly firm and supportive, and the maximum shock load is absorbed without "bottoming-out" of the foam- or fluid-filled component.

During the operation above described, the moderator element is, through deflection, shaped to form a "V" or "cup" shaped supporting surface and thereby automatically creates a system of inward directed force vectors proportional to the applied load to center the calcaneus in the shoe at the instant of full heel strike.

Additionally, the high modulus moderator elements may be extended in certain areas and formed upwardly around the perimeter of the shoe in the heel and/or the forefoot, to create a firm and dynamically responsive cantilever lateral support system within the footwear as shown in FIG. 3*a*, to translate downward forces of the calcaneus and/or metatarsals (FIG. 5*a*), F, and F2 into 90° opposing forces F3 and F4, thereby further centering and stabilizing the heel and foot within the shoe.

The result is that the psi loading on the fatty tissue surrounding the calcaneus is reduced and a remarkable degree of rear foot motion control is achieved that is directly proportional to the instantaneous and changing need of the athlete. This action reduces the need for stiff heel counters and foxing whose purpose is to keep the heel of the foot properly positioned and supported within the shoe. By supporting and centering the calcaneus, the moderator structure of this invention achieves a "banked track" effect for the heel in response to rapid changes in direction of body movement, and offers the advantage of increased stability on irregular terrain, e.g., cross-country running.

The moderator, in the fully deflected, cupped shape now resembles a Bellville spring. The negative (downward and rearward vectored shock and impact energy) at heel strike has been completely absorbed and stored in the deflected high-modulus moderator and the cushioning substrate or mid-sole material, i.e., foam- or fluid-filled material. As the center of pressure moves forward beyond the maximum downward movement of the calcaneus at heel strike, the load-bearing area of the plantar surface of the foot increases rapidly and the psi loading on the heel moderator assembly is likewise reduced rapidly. At this point, much of the negative vectored high-impact heel strike energy is returned as a positive vector force to the foot (calcaneus), the leg and the body by the spring moderator.

At full pronation, the calcaneus has thus been thrust upward to a level substantially higher than at mid-heel strike, thereby arresting the downward movement of the center of gravity of the body, and returning otherwise lost energy to the athlete in the form of an upward and foreward vector. This action initiates the upward and foreward supinated propulsive phase of the foot action a fraction of a second sooner and more efficiently than occurs without the spring moderator.

The moderator may take various forms and shapes and it may be located at different places under the foot or at various locations within the shoe structure and perform similar beneficial functions as described in the heel. Regardless of the location of the moderator of this invention, its characteristics are that it deflects without permanent deformation and in response to an applied load which creates bending stresses within the moderator element. Upon removal of, or progressive reduction of the applied load, the moderator returns to its original shape. In so doing, the moderator efficiently returns otherwise wasted energy to the wearer, since there is essentially zero time-lag in the ability of the spring moderator to change its shape in response to changes in loading. Moreover, the rate of energy transfer in the spring material of the moderator is significantly higher than the rate of energy transfer through the air-gas component of the air-gas in-sole and/or elastomeric foam substrate. The result is that the energy return more precisely matches the rate at which the load changes. Thus the shoe is more precisely "tuned" to the foot movements and the wearer's needs. It is important the the moderator be made of the appropriate materials, be the proper shape and be correctly located within the shoe so that it is able to deflect and then return to its original shape. Thus moderators properly designed, optimized for specific applications result in that footwear being; (a) lighter weight; (b) more comfortable; (c) more energy efficient; (d) less fatiguing; (e) more stable (f) decrease the risk of injury; (g) better rear foot motion control; (h) improved pronation control (i) better support for certain medical and ortnotic devices used to correct foot and leg problems.

Numerous other objects and advantages of the present invention will become apparent from the following specification which, together with the accompanying drawings, describes and illustrates preferred embodiments of this invention.

BRIEF DESCRIPTION OF THE DRAWINGS

FIG. 3*a* is a diagrammatic view illustrating the relative location of the moderator and the shoe upper and heel counter under a no-load condition;

FIG. 4*a* is a view similar to FIG. 3*a* showing the relative position of the parts, in diagrammatic form, under a medium-load condition;

FIG. 7*a* shows cross-section AA thru FIG. 7.

FIG. 8 describes yet another embodiment of a cantilever spring moderator arrangement using a multiplicity of individual shaped spring elements supported and held in position in a cloth type supported matrix.

DETAILED DESCRIPTION OF THE INVENTION

Figure 1:
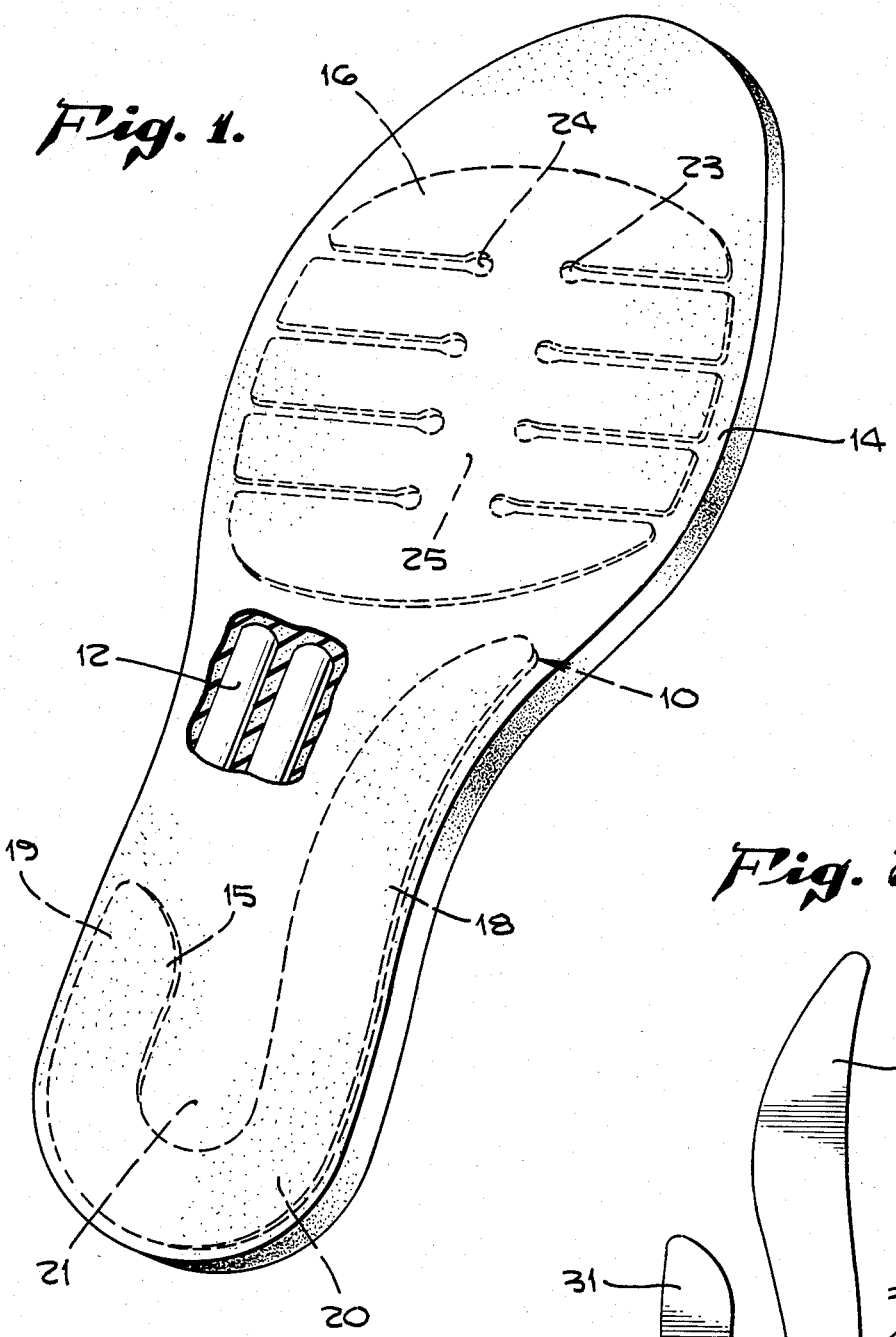
FIG. 1 is a view in perspective of an in-sole including a simple, uncantilevered moderator structure in accordance with the present invention.

Referring to the drawings, which illustrate preferred forms of the present invention, FIG. 1 shows a mid-sole, in-sole or insert 10 adapted to be used in an article of footwear. In the form shown, the integral composite mid-sole includes a foam component 14 which surrounds an air-gas inflated element 12 which may be of the type described in U.S. Pat. No. 4,219,945, for example, in which the foam encapsulates the multiple chambered inflated element 12. The mid-sole 10 may also be used in a thinner configuration, as a sock liner slipped into an existing shoe, or it can be used as an out-sole portion of a shoe.

In the form shown, the moderator is in the form of a heel moderator 15 and a fore-foot moderator 16, each shown in dotted lines and each located above the air-gas inflated or all foam element 12 which is positioned within the foam 14. The spring moderator is positioned on top of said element 12. The result is a unitary structure in which the moderator is associated with a cushioning material, which in this form is both the foam and air-gas inflated element, the latter performing the functions described in the patents previously referred to.

The moderators 15 and 16, which may be of the same or different material, are composed of a material which is spring-like and possesses a high tensile strength and a modulus of elasticity of at least 250,000 psi. Typical materials are high-modulus plastics such as polycarbonate materials (modulus of 300,000), available under the trademark "LEXAN", ABS injection molded plastic, Type "E", fiberglass composites (modulus of 3,000,000); graphite composites (modulus of 9,000,000); and various types of metals such as steel, for example C-1075HTS steel (modules of 30,000,000). Other materials which may be used are No. 301 stainless steel, cold rolled steel, full hardened stainless steel, C-1095 blue tempered cold rolled high-carbon austemuered spring steel, and other alloys, such as low and medium carbon steel, hot rolled nickel-chromium steel, vanadium alloy steels, and other materials well known in the art. The moderators may also be made of spring steel or plastic "wire", "ribbon" or heavy filament elements knit or otherwise combined with a cloth material. If desired, the material may be surface treated, especially the metals, by using an intermediate substrate such as Upjohn "estamid" resin, and/or by sandblasting or phosphate-etch to improve adhesion. Other procedures to improve adhesion as are known in the art may also be used.

The material of the moderator should possess good fatigue resistance due to the many cycles of repeat bending encountered during use, and should likewise possess those qualities present in good spring material, i.e., energy storage and return. The material of the moderator should also have a reasonably high modulus of resilience, the strain energy which which may be recovered from a deformed body when the load causing stress is removed.

To perform effectively in the context of not adding appreciable weight to the footwear, the moderator is preferably lightweight, and preferably relatively thin in order to reduce bulk. The cross-sectional thickness of the moderator may be in the range of 0.005 to 0.050 of an inch, and preferably in the range of about 0.006 to 0.020 of an inch. The moderator may be of the same thickness throughout or may vary in thickness depending on either the need for added support in localized areas. Normally, the moderator is of essentially uniform cross-sectional thickness, although the heel and forefoot moderators, or the portion forming the heel and forefoot portion of the moderator, may be of different thickness or of a different material, or both, depending upon the desired action, or may be laminated or composites of different materials to achieve special combinations of spring and support characteristics.

Again, referring to FIG. 1, moderator 15 includes a medial leg 18 along the inside of the foot and a lateral leg 19 along the outside of the foot, the moderator 15 of FIG. 1 being illustrated for use in a shoe to be worn by the left foot. When used for a shoe to be worn on the right foot, the moderator 15 is simply turned over. As illustrated, the moderator 15 includes a heel portion 20 which interconnects the medial and lateral legs such that an open portion 21 exists forward of the heel portion and between the lateral and medial legs. In lieu of an open non-spring area 21, the area 21 may be of a much thinner or softer spring material such that the heel portion, and lateral and medial legs cooperate together to function as a Bellville spring, as will be described.

In the form illustrated in FIG. 1, the forefoot moderator 16 is separate from that of the heel and is located such that it is positioned in the load-bearing area of the forefoot beneath the distal end of the metarsus.

The lateral side of the heel moderator terminates short of the lateral side of the forefoot moderator and thus provides for ready flexure in that region, while the medial leg 18 is much longer than the lateral leg to create a more firm surface for pronation control. The moderator 16 includes cut-out sections 23 and 24 arranged to permit flexure in a longitudinal section, which is a zone 25 extending transversely across the width of the moderator. Even though flexure is permitted, the moderator 16 still acts as a spring in both the longitudinal and transverse directions. This particular design of moderator assembly may be used in a court shoe such as a basketball shoe.

Figure 2:
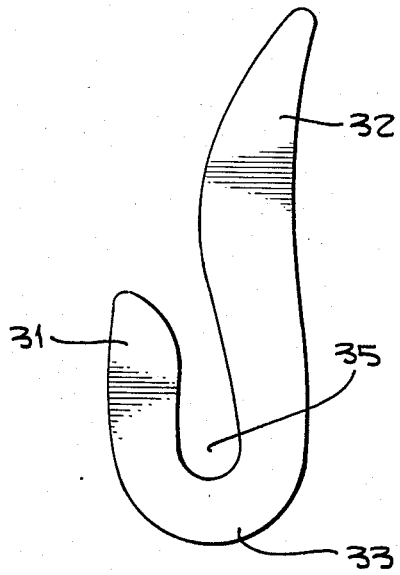
FIG. 2 is a plan view of a simple uncantilevered moderator structure in accordance with the present invention intended to be used as a heel moderator.

Referring now to FIGS. 2 and 3 through 5 and associated FIGS. 3*a* through 5*a* respectively, the function of the moderator may be better understood. As seen in FIG. 2, the moderator is shown for use in the left shoe and includes a lateral leg 31 and a medial leg 32. The legs 31 and 32 are connected to a heel portion 33 forming an open area 35 forward of the heel portion and between legs. The open portion 35 is positioned to be located under the calcaneus.

Figure 3:
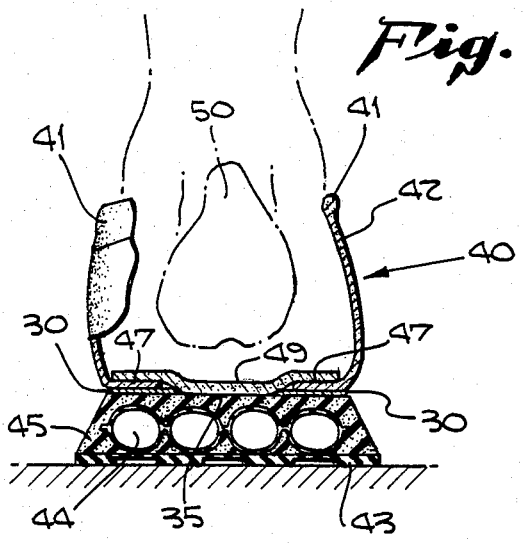
FIG. 3 is a diagrammatic view, partly in section and partly in elevation, of a shoe structure incorporating the moderator of the present invention, and indicating a no-load condition.
Figure 3:
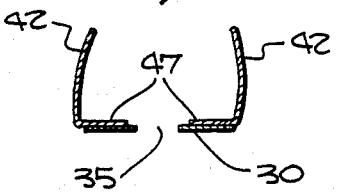

Referring to FIGS. 3 and 3*a*, the relative position of the calcaneus 50 is shown in a shoe 40 equipped with a moderator 30 as shown in FIG. 2, for example. The shoe includes an upper 41 and an outsole 43 with an air-gas member 44 which encapsulated by foam 45. The shoe upper 41 includes a heel counter 42 with a flange 47, the moderator 30 being located between the upper portion of the foam and beneath the flanges 47 which extend inwardly toward the center of the shoe. Located above the flanges is a conventional sock liner 49.

As seen in FIG. 3, the calcaneus 50 is positioned within the shoe such that the calcaneus is aligned over the open area 35 of the moderator 30 and effectively rests on a form-air-gas substrate which, in effect, forms a cushioning medium. In the condition of FIG. 3, there is no load on the shoe and the relative position of the various parts indicates the normal non-stressed condition of the moderator system. FIG. 3*a* is a diagrammatic view of the shoe counter 42 with the non-cantilevered moderator configuration 30 positioned beneath the flanges 47 as previously described, and again in the no-load condition.

Figure 4:
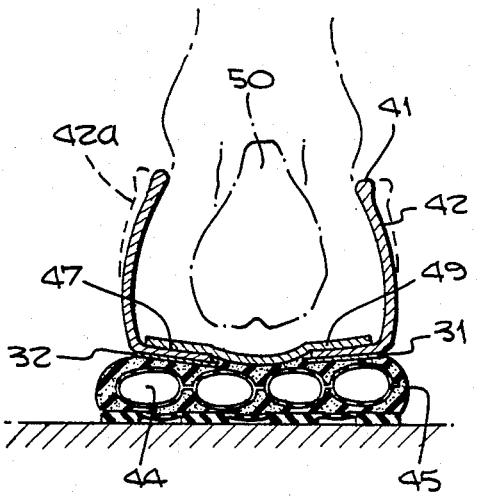
FIG. 4 is a view similar to FIG. 3 showing the relative position of the parts of the shoe structure of the present invention under medium-load conditions.
Figure 4:
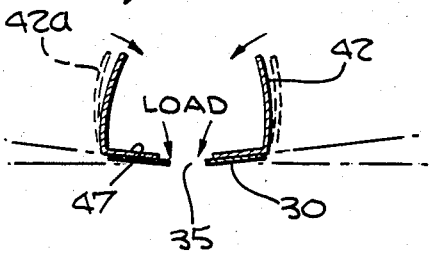

Referring now to FIG. 4, wherein the same reference numerals have been used for the same parts, and also referring to FIG. 4*a*, as a load is applied to the heel, the calcaneus sinks somewhat into the foam-air gas substrate 44, 45 resulting in small deflection of the moderator 30 under the medium load conditions imposed. As the medium load condition is imposed, the shoe counter 42 and upper 41 move from the dotted line position 42*a* to the full line position 42 gripping the foot firmly along the rear portion thereof around the rear position of the heel, both along the lateral and medial side of the foot. As the calcaneus comes down under a load condition, the moderator 30 deflects somewhat in the fashion of a Bellville spring, as illustrated in FIG. 4*a*, with the outside portions of the lateral and medial edges turning upwardly while the inner edges of the lateral and medial sides are urged downwardly, as schematically shown in FIG. 4*a*. The result is to urge the upper portion of the shoe to tilt inwardly more tightly against the bale of the heel of the foot in the response to the applied medium load. In so deflecting, the moderator absorbs, redistributes and stores the energy of the localized load such that the load is transmitted radially outward throughout the spring moderator, progressively, as increased deflection takes place. Since the greatest downward load is in the area immediately beneath the calcaneus, there is greater deflection of the inner edges of both the medial and lateral legs of the moderator 30. If the medium load is then removed, the moderator immediately returns to its original shape and at a rapid rate which closely follows the rate at which the load is removed. These movements of the various portions of the shoe are apparent from a comparison of FIG. 4 with FIG. 3, or FIG. 4*a* with FIG. 3*a*. In In returning to the original condition, the moderator returns to the user the energy absorbed as stresses within the moderator material during imposition of the applied loads.

Figure 5:
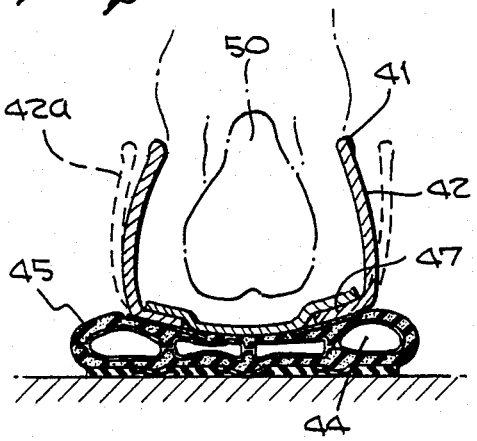
FIG. 5 is a view similar to FIGS. 3 and 4 illustrating the relative position of the parts of the shoe of the present invention under heavy load conditions; and, FIG. 5*a* is a view similar to FIGS. 3*a* and 4*a* diagrammatically illustrating the relative position of the parts under heavy load conditions.
Figure 5:
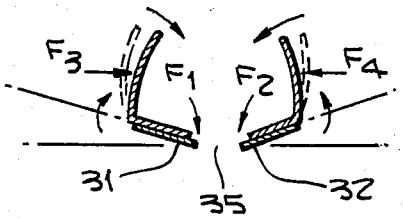

As illustrated in FIGS. 5 and 5*a*, again where the same reference numerals have been applied to the same parts, the imposition of a heavy load results in increased deflection over that shown in FIGS. 4 and 4*a*, with the result that there is greater deflection, elastically, of the moderator and tighter engagement between the bale of the heel and the shoe upper in the region of the heel counter so as to cup and lock the calcaneus and to center the heel in the shoe, thus providing firm and stable support under heavy load conditions of a degree somewhat greater than was achieved under medium load conditions.

The action which occurs at the forward end of the shoe is somewhat similar (however more firm) in that moderator 16 functions to deflect in response to the applied load, thus absorbing the load and redistributing the energy over the ball area of the foot, while storing the energy of the localized load. Upon removal of the load, the moderator returns to its original shape and in so doing returns to the wearer the energy which is stored as a result of the deflection of the moderator as well as returning to the wearer the energy which has been stored in the foam-air-gas cushioning material beneath the moderator in the forefoot region of the shoe.

Dynamic laboratory tests of the shoe elements including the moderator system of the present invention have indicated that a shoe design of the type illustrated in FIGS. 3–5, for example, store and return impact energy 16% more efficiently than the same shoe structure without the moderator of the present invention. (See FIG. 9)

As previously described, the moderator of the present invention significantly improves the performance of conventional footwear using an all foam midsole alone as opposed to a cushioning medium in the form of a foam encapsulated air-gas system. While the air-gas system performs per se much better than does a purely foam in-sole system, the moderator of the present invention also functions in a somewhat similar fashion to that already described when used in connection with shoe structures in which the moderator is positioned over a cushioning medium comprised entirely of foam. The action of the moderator is identical to what has been described in connection with FIGS. 3–5, although the amount of energy return is not as great because the amount of energy storage in the foam meterial is not as great as in an air-gas system or a foam encapsulated air-gas composite.

As can be seen from the above description, the moderator of the present invention also provides improvement in activities such as running and in the case of activities involved in court sports such as basketball, in that if the athlete's foot lands either on the medial or lateral side, there is an absorption, redistribution and storage of energy, because the entire moderator system is capable of flexing in response to the applied loads. More particularly, if an athlete lands off-center on the medial side of the foot, the medial side of the moderator system deflects downwardly and the lateral side tends to raise up, thus providing advantages comparable to those described, i.e., snugging of the shoe around the foot to provide comfort and support during that type of load-bearing activity. In addition, a vector force is created tending to push the foot back toward the center of the shoe. Thus a self-centering feature is provided by the action of the moderator spring.

Moderator 16 is provided with a plurality of fingers extending transversely of the shoe in order to provide greater flexibility in the transverse direction, that is across the lateral and medial side of the foot.

Figure 6:
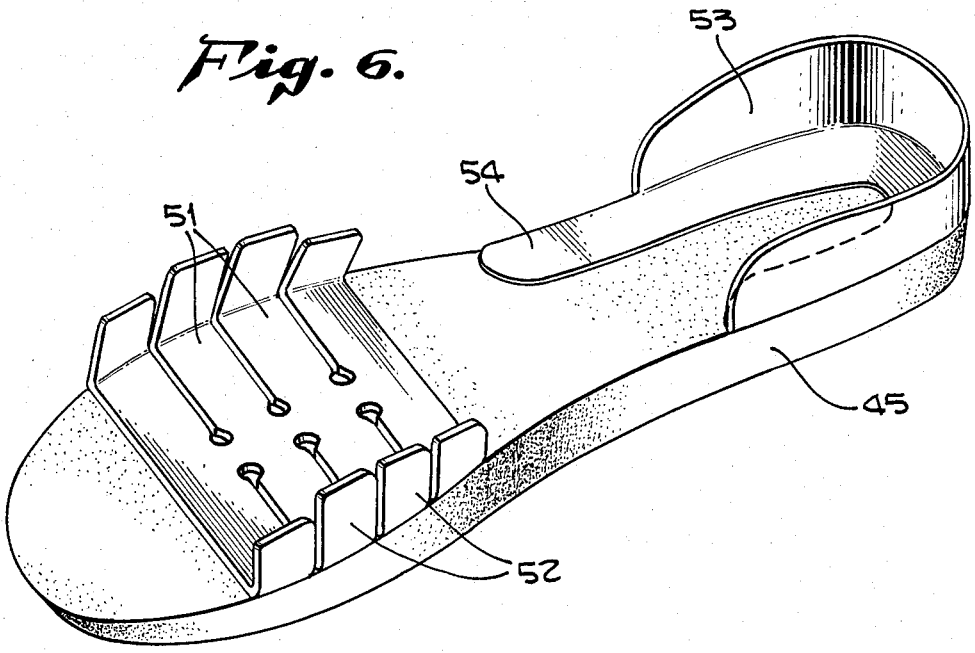
FIG. 6 describes one modification of the basic moderator incorporating dynamic cantilever spring support elements.
Figure 7:
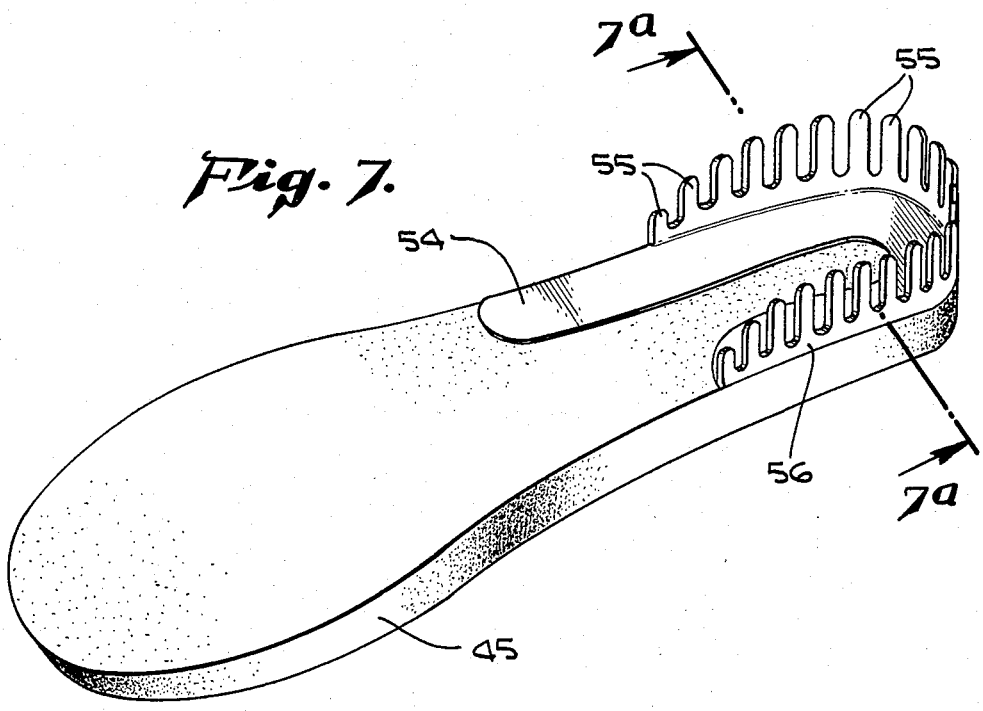
FIG. 7 describes another modification of the dynamic cantilever spring arrangement.

In FIGS. 6, 7, and 8, moderator 16 may be in the form of a plurality of fingers 51 extending from the lateral to the medial side with the ends of the fingers including upturned cantilever portions 52, 53, 55, 57 in order to provide greater support around the edges of the shoe for those types of activities in which there is a lot of forefoot action and in which the athletes may land either on the medial or lateral side of the forefoot. The upstanding cantilever flanges 53 and 55 are extended from ½ to 1 inch above the rear moderator 54, as illustrated, and operate additionally deflect to store energy as well as to assist in cupping the forward and heel areas of the shoe against the foot to provide added comfort and support and to help prevent the forefoot from sliding sideways within the shoe. As illustrated, the portions 53 and 55 of the rear moderator and the portions 52 of the forward moderator are oriented approximately 90 degrees from the plane of the respective moderators.

It is also possible, in accordance with the present invention, to use a moderator only under the forefoot of the shoe, particularly with those shoes in which the type of activity normally does not involve heel impact; for example, speed running in which the shoe includes a spike portion principally under the forward end of the shoe and wherein the heel of the shoe generally does not strike or impact the ground during the normal course of the sporting event. In that type of structure, the advantages previously described are obtained.

In another form of moderator in accordance with this invention, the moderator may include portions which are serpentine in structure in order to provide increased bending and flexibility in certain areas of the shoe structure. For example, the portion of the medial side of the moderator may include a serpentine tip which permits easy flexure in the area underneath the arch while also providing arch support. So, too, the lateral side of the moderator may include a serpentine strip for flexibility while the portion of the moderator beneath the forefoot may likewise be made of a serpentine strip which in effect provides a plurality of parallel fingers with adjacent fingers interconnected at their opposite ends, thereby providing flexibility and support in addition to the functions already previously discussed. A degree of control of flexibility in various directions can also be achieved by using moderator materials which have a different modulus of elasticity in different directions. For instance, composite fiberglass or graphite composites can have significantly different stiffness in directions 90° to one another.

Figure 9:
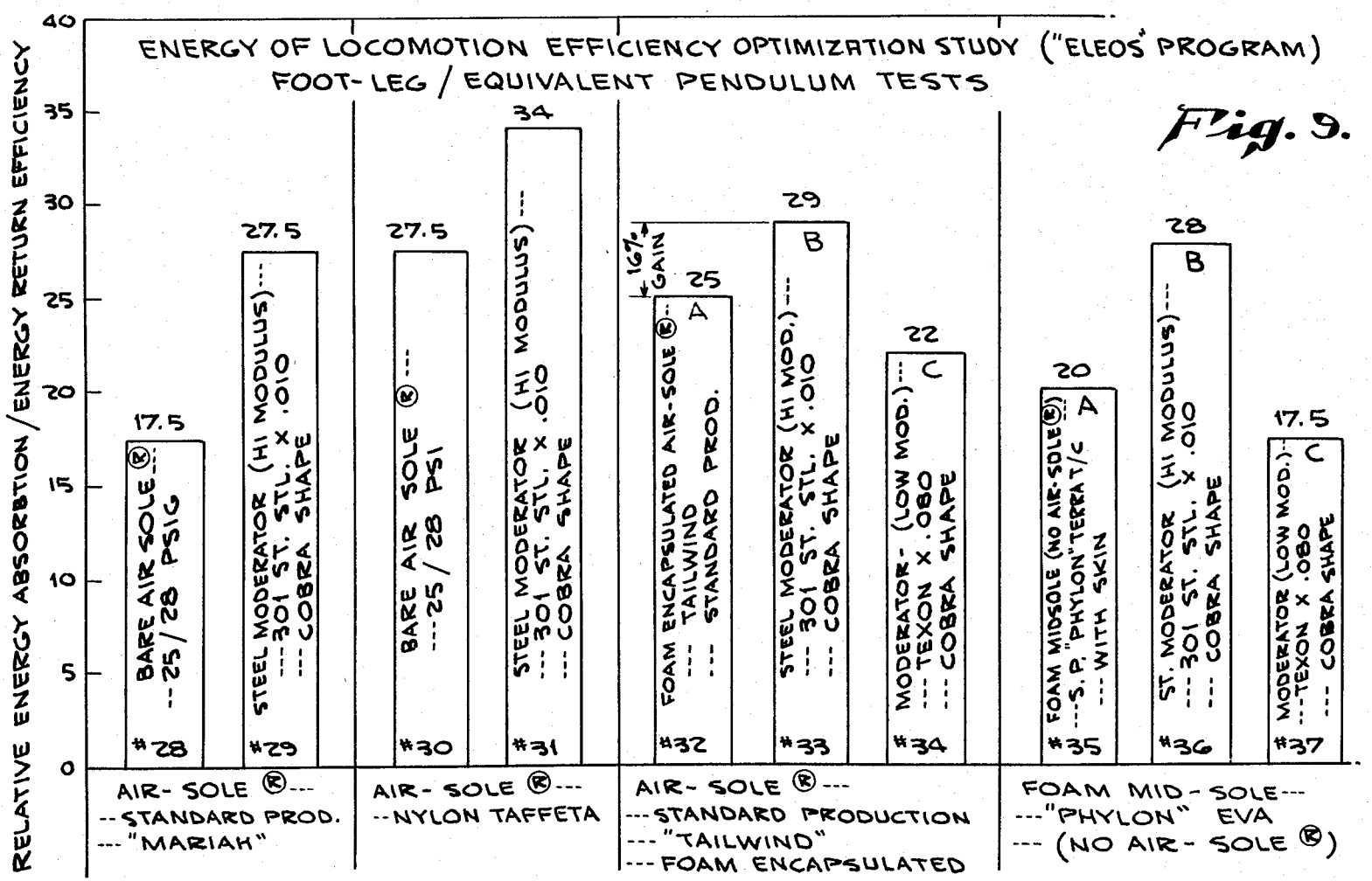
FIG. 9 is a bar chart showing test results compairing the energy storage and return efficiencies of various foam, "air" and conventional moderator devices with and without the subject high modulus spring moderator invention.

FIG. 9 is a bar chart summarizing tests showing the relative energy absorption and energy return efficiency of the moderator system of the present invention. A series of pendulum tests were performed which basically involved allowing a pendulum, simulating the lower leg and foot, to strike against the system under test (which was positioned on a firm anvil) and counting the number of strikes. In the tests performed, the pendulum weight was approximately 45 pounds, and the test specimens were rigidly supported against a suitable support mechanism such that the pendulum was free to swing, strike the test specimen, bounce back, and thereafter continue to swing back and forth so as to freely hit the test specimen in a repititious fashion. A count of the number of times the test specimen was hit until the pendulum no longer came in contact with the specimen provided a relative indication of the efficiency with which the system under test returned energy to the pendulum. In each test in the series there were multiple runs of each of the systems tested and the numbers for each system were averaged over the number of runs.

In the first test, a comparison was made between an air-gas in-sole which was not encapsulated in foam and essentially of a structure described in U.S. Pat. No. 4,183,156, inflated to approximately 25 to 28 psi guage. This air-gas system product was one presently used commercially in a brand of shoes known as MARIAH. Multiple runs were made in which the number of impacts by a 45-pound pendulum were counted and until the pendulum stopped impacting the test specimen and the numbers averaged out to 17.5. In the companion test of the same material, a moderator was used essentially as shown in FIG. 2 and composed of 301 full hard stainless steel of a thickness of approximately 0.010 of an inch. The moderator was assembled into contact with the air-gas system in-sole tested in the first series, and the result of multiple runs of the second system indicated an average of 27.5 total impacts. The increase in approximately ten impacts (or 57) is an indication of the increase in the relative energy return efficiency between the same air-gas system with and without the moderator of the present invention.

In another series of tests, an improved air-gas in-sole using a nylon taffeta enclosure material inflated to approximately 25 to 28 pounds was tested, resulting in an average number of impacts of 27.5. The same material run in a companion test using the moderator already described, produced 34 impacts. The tests, when repeated, produced remarkably consistant results. The efficiency differences are significant.

In a third series of tests, three different structures were tested, as follows. Structure A was a foam-encapsulated air-gas system as illustrated in FIG. 1 of this application, and described in detail in U.S. Pat. No. 4,219,945 and in a form currently being used commercially in a shoe sold under the designation TAILWIND. Structure B was identical to Structure A except it incorporated a moderator of the configuration illustrated in FIG. 2 of this application, the moderator being fabricated 301 full hard stainless steel and having a cross section thickness of 0.010 of an inch. Structure C included the air-gas-foam substrate of Structure A except that the moderator, (configuration of FIG. 2 of this application) was structured of a non-spring material common to the footwear industry and having a comparatively low modulus less than 10,000 psi. The trade name of this material is "Texon". The material was 0.080 of an inch in cross-sectional thickness. In Structure C, the low modulus moderator was assembled over the air-gas system tested in Structure A. Each test was repeated a number of times and the results averaged to provide the following number of impacts: (a) Structure A, 25 impacts, (b) Structure B, 29 impacts, and (c) Structure C, 22 impacts.

In still another series of tests, three additional structures were evaluated including Structure A, which was an ultra light weight foam material used as a mid-sole of the Terra T.C. shoe. It was a special ethylene vinyl acetate/polyethylene co-polymer material. The second Structure B was the ultra light weight foam mid-sole of test "A" using a high-modulus 301 full hard stainless steel moderator of a shape illustrated in FIG. 2 and having a cross-sectional thickness of 0.010 of an inch. The third Structure "C" tested the foam mid-sole of test "A" with a low-modulus moderator of "TEXON" as already previously described. Again, each test was repeated a number of times with the following results: (a) foam mid-sole alone, 20 impacts; (b) foam mid-sole with steel moderator, 28 impacts; and (c) foam in-sole with TEXON moderator, 17.5 impacts.

In the tests above described, the moderator shape was the same and located approximately in the same position for each of the tests. The pendulum was arranged in each test to strike the specimen at approximately the same location as the calcaneus would impact the system when built into a shoe.

On the basis of the above data, the presence of a high-modulus moderator consistently improved the energy absorption and energy return characteristics of the system under test. The use of a high-modulus moderator in combination with on all foam mid-sole increased the energy absorption and energy return characteristics to a level greater than the same system without the moderator and to a level greater than that of foam-encapsulated air-gas systems. The use of low-modulus moderators demonstrated a significant loss of efficiency when used either with foam-encapsulated air-gas systems or with foam systems. The performance of the nylon taffeta cloth Air-Sole® which was urethane coated, and which included a high-modulus moderator was the most efficient system of all of those tested in the series.

Actual footwear tests with professional athletes using special shoes incorporating the subject invention are in progress. To date, the athletes testing the system consistantly prefer shoes with the spring moderator. Several new world records have been set by a world class athlete incorporating the subject invention.

From the above description, it will become apparent that the use of a moderator of a high modulus-of-elasticity material, significantly improves the performance of footwear in the absorption, redistribution, storage of energy as a result of deflection of the moderator by applied loads, and by returning energy to the wearer in a useful form. It is within the scope of the present invention to provide a moderator assembly which includes a moderator which overlies a cushionable substrate and which is separate from the shoe structure as manufactured and which may be inserted into any shoe.

In addition to providing the energy return chacteristics described, the moderator of the present invention also provides the advantage of increased comfort and support. This is particularly true in those types of physical activities where the athlete must start, stop, change direction rapidly, jump, run on irregular or hilly terrain, or run on roads of hard surfaces. Unlike the moderators of the prior art, the moderator of the present invention is effective, through elastic deflection and return, in efficiently returning to the wearer energy which heretofore, and in some of the prior art systems, have been dissipated and lost. In further dynamic tests (athletes actually running in the shoes) using a foam-encapsulated air-gas system and the moderator of the present invention, an increase of up to approximately 6% to 6½% in athlete efficiency has been noted. This translates into a very substantial advantage for the professional and amateur athlete alike. This is particularly true for the distance runner.

It is contemplated that numerous changes, modifications and/or additions may be made to the specific embodiments of the present invention shown in the drawings and described above without departing from the spirit and scope of the present invention. Accordingly, it is intended that the scope of this patent be limited only by the scope of the appended claims.

What is claimed is:

1. An article of footwear of the type described, comprising:

an upper and at least a sole secured to said upper such that the wearer's foot is positioned within said upper and above said sole, cushioning material located between said sole and the wearer's foot, a high modulus moderator located between the wearer's foot and above said cushioning material, said moderator being a relatively thin, lightweight member of a material having a modulus of elasticity of at least 250,000 psi, said moderator including a medial leg and a lateral leg and a heel portion interconnecting said two legs, said legs and heel portion being relatively flat, said moderator being positioned at least within said midsole and above said cushioning material such that when the wearer's foot is inserted into the footwear the medial and lateral legs overlie the cushioning material and are located on each side of the calcaneus while the rear portion of the moderator overlies the cushioning material and is located behind the calcaneus whereby a cushioning medium is provided below the calcaneus, said moderator being charaterized further by the ability to deflect without permanent deformation in response to an applied load creating a deflecting stress and to return to its original shape upon removal of the applied load causing the deflecting stress, said medial and lateral legs including peripheral portions spaced from the location of the calcaneus and portions adjacent to the location of the calcaneus whereby in response to a load the portions of said moderator adjacent to the calcaneus deflect in one direction while the portions thereof spaced from the calcaneus deflect in another direction, said moderator including portions oriented approximately 90 degrees upward from the plane of the moderator and located at least along a portion of the medial and lateral legs thereof, and said moderator being operative to absorb, redistribute and store the energy of localized loads applied thereto through deflection and to return energy to the wearer at a rate equal to or greater than the rate which the applied load is removed.

2. An article of footwear as set forth in claim 1 wherein said moderator has a cross-sectional thickness of between 0.005 and 0.050 of an inch.

3. An article of footwear as set forth in claim 2 wherein said moderator is of a spring steel alloy.

4. An article of footwear as set forth in claim 1 wherein said moderator is reinforced composite plastic.

5. An article of footwear as set forth in claim 1 wherein said medial leg is longer than said lateral leg.

6. An article of footwear as set forth in either of claims 4 or 5 wherein the foam encapsulates the moderator.

7. An article of footwear as set forth in claim 1 wherein one of said lateral leg and medial legs is longer than the other.

8. An article of footwear as set forth in claim 1 wherein said cushioning material is a compressible foam.

9. An article of footwear as set forth in claim 1 wherein said cushioning material is a foam encapsulated air-gas material.

10. An article of footwear as set forth in claim 1 wherein said cushioning material is an air-gas material.

11. An article of footwear as set forth in claim 1 wherein said cushioning material includes a pressurized air-gas material.

12. An article of footwear as set forth in claim 1 wherein said upper includes a heel counter having a flange means which extends inwardly, said flange means being located on one side of said moderator, and said flange means cooperating with said moderator and said cushioning material to urge the upper into tight contact with the ball of the wearer's heel in response to a load applied to said moderator.

13. An article of footwear as set forth in claim 1 wherein there is a space between the portions of the medial and lateral legs of the moderator adjacent to the location of the calcaneus, and said cushioning material including a portion in the said space between said legs and located beneath the calcaneus such that when a load is applied the calcaneus is cushioned by the cushioning material while the moderator deflects.

14. An article of footwear as set forth in claim 1 wherein additional moderator means are positioned in the forefront of said footwear, said additional moderator being a relatively thin, lightweight member of a material having a modulus of elasticity of at least about 250,00 psi, and being characterized further by the ability to deflect without permanent deformation in response to an applied load creating a deflection stress, and being operative to absorb, redistribute, and store the energy of localized loads applied thereto through deflection and to return energy to the wearer at a rate equal to or greater than the rate at which the applied load is removed therefrom.

15. An article of footwear as set forth in claim 1 wherein said additional moderator means positioned in the forefoot of said footwear is relatively flat and includes medial and lateral side portions oriented approximately 90 degrees upward from the plane thereof and located at least along the medial and lateral sides thereof.

16. An article of footwear as set forth in claim 1 wherein said portions extend from ½ to 1 inch above the plane of said moderator.

17. A cushioning material and moderator assembly of the type described for use in footwear, comprising:

a moderator of a relatively thin, lightweight material having a modulus of elasticity of at least about 250,000 psi, a cushioning material located beneath said moderator to permit said moderator to deflect without permanent deformation in response to an applied load creating a deflecting stress and permitting said moderator to return to its original shape upon the removal of the applied load causing the deflecting stress, said moderator including a medial leg and a lateral leg and a heel portion interconnecting said two legs, said legs and heel portion being relatively flat, a member overlying said moderator and cooperating therewith to form an insert which may be placed in the footwear and positioned therein such that the calcaneus of the wearer's foot is located between said legs and forward of the heel portion of the moderator and overlies a portion of said cushioning material, said moderator being characterized further by being relatively flat in a no-load condition and by the ability to deflect without permanent deformation in response to an applied load creating a deflecting stress and to return to its original shape upon removal of the applied load causing the deflecting stress, said medial and lateral legs including peripheral portions spaced from the location of the calcaneus and portions adjacent to the location of the calcaneus whereby in response to a load the portions of said moderator adjacent to the calcaneus deflect in one direction while the portions thereof spaced from the calcaneus deflect in another direction, said moderator including portions oriented approximately 90 degrees upward from the plane of the moderator and located at least along a portion of the medial and lateral legs thereof, and said moderator being operative to asborb, redistribute and store energy of localized loads applied thereto through deflection and to return energy to the wearer at a rate equal to or greater than the rate at which the applied load is removed.

18. A cushioning material and moderator assembly as set forth in claim 17 wherein said cushioning material is a compressible foam.

19. A cushioning material and moderator assembly as set forth in claim 17 wherein said cushioning material is a foam encapsulated air-gas material.

20. A cushioning material and moderator assembly as set forth in claim 17 wherein said cushioning material is an air-gas material.

21. A cushioning material and moderator assembly as set forth in claim 17 wherein said cushioning material includes a pressurized air-gas material.

* * * * *